US006638037B2

(12) United States Patent
Grant

(10) Patent No.: US 6,638,037 B2
(45) Date of Patent: Oct. 28, 2003

(54) MOUNTING BRACKET FOR FAN MOTOR

(76) Inventor: Alan Peter Grant, 4 Twyford Court, Toronto, Ontario (CA), M9A 1W7

( * ) Notice: Subject to any disclaimer, the term of this patent is extended or adjusted under 35 U.S.C. 154(b) by 0 days.

(21) Appl. No.: 10/104,142

(22) Filed: Mar. 22, 2002

(65) Prior Publication Data

US 2003/0133815 A1 Jul. 17, 2003

(30) Foreign Application Priority Data

Jan. 16, 2002 (CA) ..... 2368365

(51) Int. Cl.[7] ..... F04B 17/00; F16M 1/00
(52) U.S. Cl. ..... 417/423.15; 417/360; 248/674
(58) Field of Search ..... 417/423.15, 360, 417/355; 416/244 R; 415/213.1; 248/674; D23/370

(56) References Cited

U.S. PATENT DOCUMENTS

| | | | | |
|---|---|---|---|---|
| 1,781,155 A | | 11/1930 | Anderson | |
| 1,986,176 A | | 1/1935 | Zwerling | |
| 2,557,223 A | | 6/1951 | Hans | |
| 2,731,193 A | | 1/1956 | Lall et al. | |
| 2,740,579 A | | 4/1956 | Welsh | |
| 4,036,292 A | | 7/1977 | Hine, Jr. | |
| 4,171,937 A | | 10/1979 | Greenfield | |
| 4,394,111 A | * | 7/1983 | Wiese et al. | 417/360 |
| 5,492,456 A | | 2/1996 | Knight et al. | |
| 6,443,714 B1 | * | 9/2002 | Hollenbeck et al. | 417/423.1 |
| 6,454,528 B2 | * | 9/2002 | McCabe | 415/147 |

OTHER PUBLICATIONS

Continental Fan Manufacturing, AEROFAN Product Advertisement and Description, Dec. 12, 1998.
Aerovent Inc., "Panel and Ring Fans", Bulletin 166–A, Apr. 1985, p. 1.

* cited by examiner

*Primary Examiner*—Charles G. Freay
*Assistant Examiner*—Michael K. Gray
(74) *Attorney, Agent, or Firm*—Baker & Daniels

(57) ABSTRACT

A fan apparatus comprising a fan with fan blades, a motor for rotating the fan blades, this motor having a rotatable output shaft projecting from one end and a fan support structure capable of supporting the fan and its motor and having an opening for an airflow through the fan. The support structure includes two support brackets connected to motor mounting surfaces on opposite sides of the motor and extending between the motor and a fan-supporting panel or housing. Each support bracket is formed from one integral metal piece comprising a central section, which is connected to the motor mounting surface by bolts, and two similar wing sections extending from opposite ends of the central section. Each wing section forms an obtuse angle with the central section and is detachably connected by bolts to the panel or housing. The obtuse angle is preferably about 135 degrees.

20 Claims, 4 Drawing Sheets

MOUNTING BRACKET FOR FAN MOTOR

BACKGROUND OF THE INVENTION

This invention relates to fan apparatus and, in particular, to a support bracket for a fan motor and attached fan.

It is well known in the fan industry to support an electrical motor with an output shaft on which a fan device is mounted on a suitable support structure, such as a housing, whereby the fan is located adjacent to or in an opening for the airflow that passes through the fan blades. In some cases, the fan and its motor are mounted on a rectangular panel structure that can have a circular opening formed therein with the diameter of this opening corresponding substantially to the total diameter of the fan blades. It is also known to mount a fan and its drive motor on a rigid ring member which also forms a suitable opening for the airflow through the fan. It is known to mount the motor on the panel or on the ring by means of bracket members or struts which can be, for example, attached to a motor mounting surface on one side of the motor housing. Generally speaking, the struts or brackets which are attached to and support the motor and its fan must have sufficient rigidity and strength to not only support the weight of the motor and its fan but also to avoid vibration problems which may arise once the fan is in operation.

U.S. Pat. No. 4,171,937 issued Oct. 23, 1979 to Rheem Mfg. Co. describes one known method for mounting a fan motor to a grill panel made of sheet metal. The supporting panel includes sectors of louvers arranged about a center support section against which the fan motor is supported. This known fan apparatus which is designed for a condenser unit employs a bracket assembly made of four substantially identical bracket members, the assembly being attached to the inside surface of the panel. Each bracket member is formed with three sections, including a first section located adjacent the side of the motor and a relatively long bracing section located at one end of the first section and extending at an obtuse angle thereto. A third tab section is located at the end of the first section which is opposite the bracing section. It is noted that the first section and the bracing section can be permanently attached to the adjacent center support section of the grill panel by welding. The four bracket members after they are fitted together form an encircling bracket for the fan motor with the bracing section of each bracket member extending from a respective corner of the square that surrounds the motor. A difficulty with this construction is that it does not permit easy, on site attachment or detachment of the bracket members from the grill panel and it may in addition require that the grill panel itself have a central supporting section for the fan motor.

Earlier U.S. Pat. No. 2,557,223 describes another type of fan support for locating a fan in an opening in a housing. In this case, a split collar is arranged around the side of the motor housing and this collar can be secured to the motor housing by tightening a bolt that extends through two outwardly projecting flanges connected to the collar. The collar is connected to a circular member that also extends around the side of the motor and projecting outwardly from this circular member are a plurality of outwardly inclined radial arms, the outer extremities of which terminate in and are integral with a ring which is coaxial with the circular member and the shaft of the motor. Formed integral with this ring and projecting outwardly therefrom are a plurality of flanges which can be used to attach the motor support structure to a wall or fan housing. It will be seen that this fan support structure would be relatively difficult to construct and it does not appear to be adaptable to different types of motors and different sizes of motors.

It is an object of the present invention to provide a simple and relatively inexpensive support bracket that can be used to support a fan motor and its attached fan adjacent an opening.

The preferred support bracket of this invention can be quickly assembled and only one type of support bracket need be held in inventory for a particular fan and motor size. The disruption of airflow through the opening is minimized by the use of the support brackets of this invention because only the thickness of the metal used in each bracket interferes with the airflow close to the fan blade track.

SUMMARY OF THE INVENTION

According to one aspect of the invention, a support bracket for a fan motor and attached fan is formed from an integral metal piece and comprises a substantially planar central section adapted for connection to a side of the fan motor and two substantially similar wing sections extending from opposite sides of the central section. Each wing section extends at an obtuse angle of about 135 degrees to the central section and is adapted for detachable connection using threaded fasteners to a main fan and motor supporting member at an outer end of the wing section.

Preferably the bracket is made from sheet metal and each wing section tapers in width from an inner end adjacent the central section to the outer end thereof. Each wing section can be formed with an elongate stiffening flange along one longitudinal edge thereof According to another aspect of the invention, a fan apparatus comprises a fan device having fan blades, a motor for rotating the fan device, and a fan support structure capable of supporting both the fan device and the motor. The motor has a rotatable output shaft projecting from one end of the motor and on which the fan device is mounted. The fan support structure forms an opening for passage of an airflow through the fan device. This structure includes a support member defining the opening and two substantially similar support brackets connected to motor mounting surfaces on opposite sides of the motor and extending between the motor and the support member. Each support bracket is formed from one integral metal piece and comprises a central section connected to its respective motor mounting surface by means of fasteners and two substantially similar wing sections extending from opposite ends of the central section. Each wing section forms an obtuse angle with the central section and is detachably connected to the support member at an outer end of the wing section.

In a particular preferred embodiment, each wing section is formed with a connecting flange at its outer end and each connecting flange is attached by bolts and cooperating threaded nuts to the support member.

Further features and advantages will become apparent from the following detailed description taken in conjunction with the drawings.

DETAILED DESCRIPTION OF PREFERRED EMBODIMENTS

Figure 1:
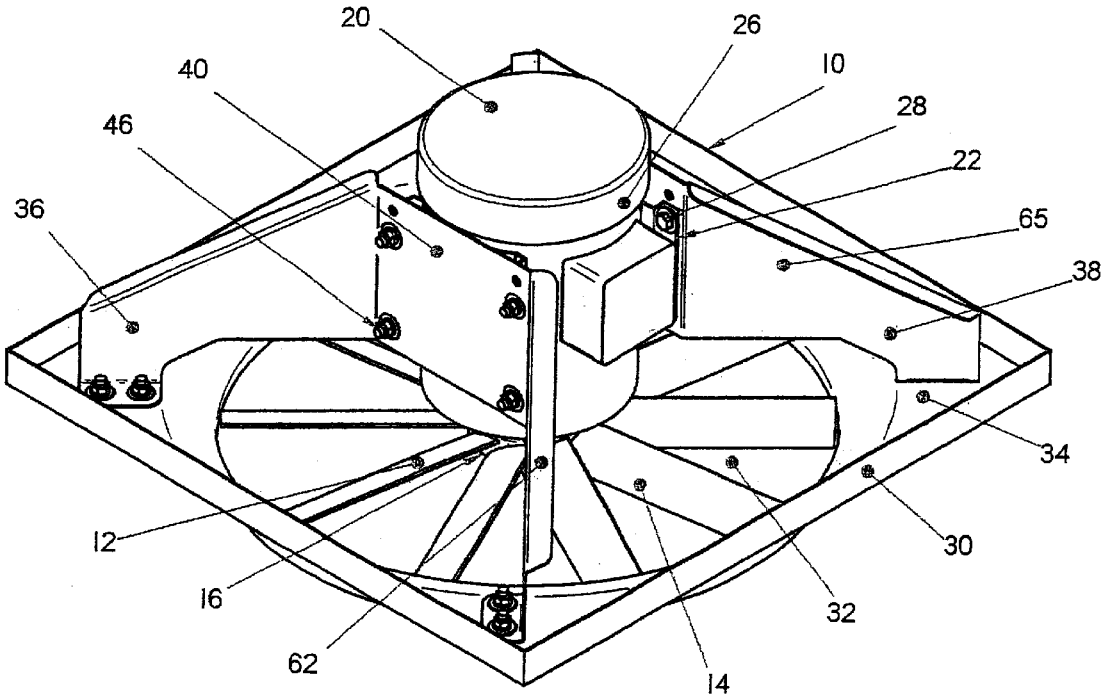
FIG. 1 is a perspective view of a fan apparatus constructed in accordance with the invention, this view being taken from one side of the fan motor and showing one end of the motor housing.

A fan apparatus 10 constructed in accordance with the invention includes a fan device or fan propeller 12 having a plurality of fan blades 14. The type of fan illustrated is also known as an axial fan. It will be appreciated that the number of blades can vary as well as the size of the blades, the size and number depending upon the particular fan requirements. The blades extend from a circular fan hub 16 which, in a well known manner, can be fixedly secured to a rotatable output shaft indicated in dash lines at 18 in FIG. 2. The shaft projects from a front end of a standard electrical, fan motor 20 which can be of standard construction, except that it is provided with two motor mounting plates 22, 24 instead of the usual one mounting plate. These mounting plates, which are flat at least on their outer surface, are attached to opposite sides of a motor housing 26 for the motor 20. The mounting plates, which can be rectangular, are provided with a number of bolt receiving holes 28, for example, one hole in each of the four comers of the plate. Instead of a rectangular mounting plate on each side of the motor, it is also possible to use a set of mounting feet on each side as is known in the fan motor art.

Figure 2:
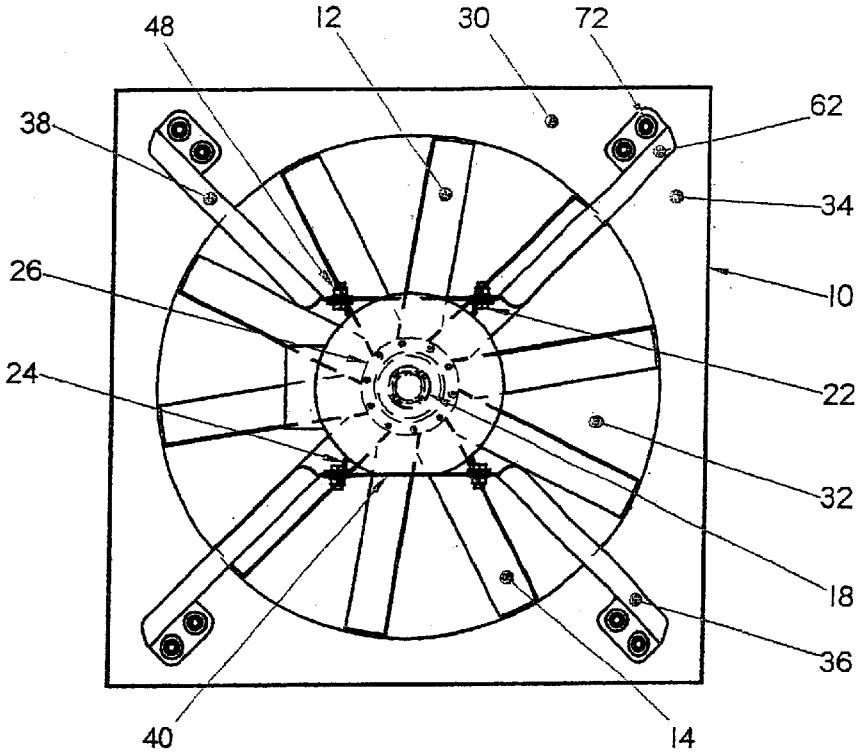
FIG. 2 is an end view of the fan apparatus of FIG. 1.
Figure 3:
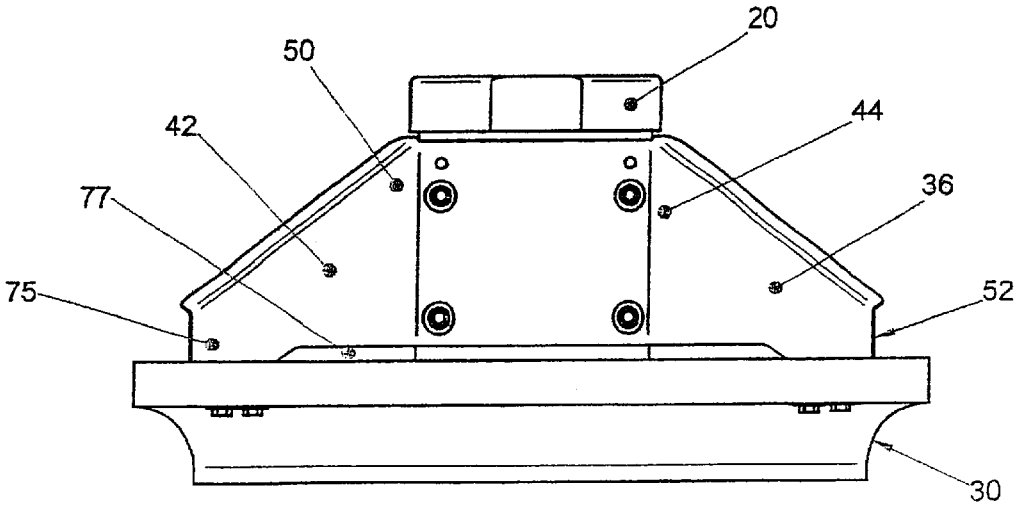
FIG. 3 is a side view of the fan apparatus of FIGS. 1 and 2.

The fan apparatus 10 includes a fan support structure indicated generally at 30 capable of supporting both the fan device 12 and its motor 20 and forming an opening 32 which is generally circular and which has a diameter substantially the same as the total effective diameter of the blades of the fan device as shown in FIGS. 1 and 2. The opening 32 forms a passage for airflow through the fan device, the direction of this airflow depending upon the particular application for the fan apparatus, the direction of rotation of the fan blades, and their orientation.

The main components of the support structure 30 are a support member 34, which can take the form of a machinery housing or portion thereof, and two support brackets 36, 38 connected to motor mounting surfaces formed by the aforementioned mounting plates 22, 24 or by two sets of mounting feet. The motor mounting surfaces are on opposite sides of the motor 20 as shown and the two support brackets extend between the motor 20 and the support member 34. Generally, the support member defines the opening 32 and this member may be in the form of a rectangular panel (as shown) or in the form of a circular ring having a circular exterior perimeter. The use of rings for mounting fans and their respective motors is well known in the fan industry and accordingly further description of such rings herein is deemed unnecessary.

Each support bracket 36, 38 is formed from one integral metal piece with the type of metal chosen depending upon the particular fan installation requirements. Suitable sheet metals for the fan bracket include sheet steel, aluminum sheet, galvanized steel and stainless steel. The bracket comprises a central section 40 which is connected to its respective motor mounting surface, and two, substantially similar wing sections 42, 44 extending from opposite ends of the central section. Each wing section forms an obtuse angle indicated by A in FIG. 4 with the preferred angle being 135°. Preferably the wings extend in a radial direction relative to the central axis of the fan.

Figure 4:
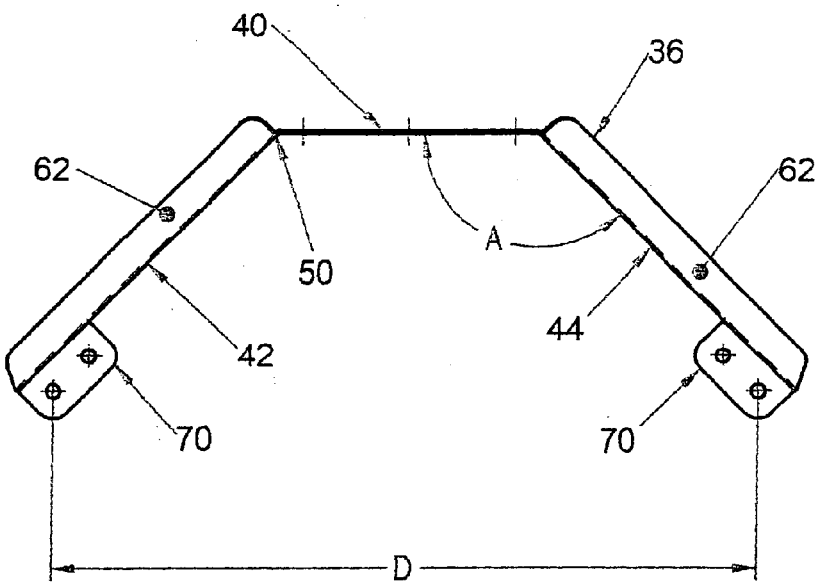
FIG. 4 is an end view of a preferred form of support bracket constructed in accordance with the invention.
Figure 5:
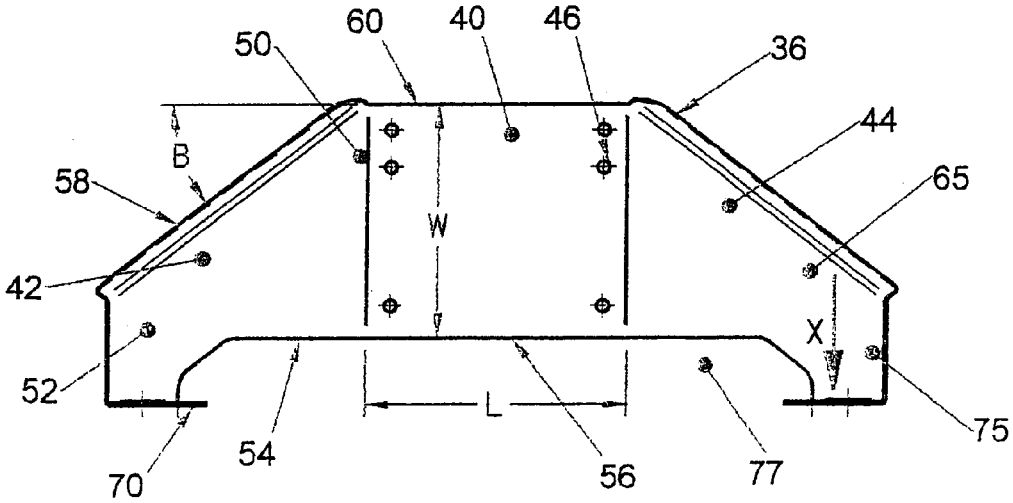
FIG. 5 is a side view of the support bracket of FIG. 4.

The central section 40 is connected to its respective motor mounting surface formed by plate 22 or 24 by means of fasteners which extend through a plurality of holes 46 formed in the central section. As illustrated in FIGS. 4 and 5, the preferred embodiment has six bolt holes arranged in two parallel rows with three holes in each row. To permit easy attachment of each support bracket to the motor housing both in the factory and on site, standard motor mounting bolts 48 (and if necessary, cooperating nuts) are used as the fasteners to connect the bracket to its respective mounting plate or mounting feet. It will be understood that these bolts extend through the holes 46 and aligned holes 28 in the adjacent mounting plate or feet. The hole patterns for the holes 46 are set-up to enable the bracket to be used with different possible frame sizes of the drive motor 20. For example, in one preferred embodiment, the hole pattern is arranged to enable the bracket to be connected to both frame 182T and frame 184T motors. Similarly, bolts can be used to detachably connect the outer end of each wing section to the support member or panel 34.

The preferred support bracket will now be described in more detail with particular reference to FIGS. 4 and 5 of the drawings where one support bracket is shown separately. Each wing section 42, 44 tapers in width from its inner end 50 located adjacent the central section 40 to its outer end 52. One longitudinal edge 54 of each wing section extends parallel to and is aligned with one edge 56 of the central section 40. However, the opposite longitudinal edge 58 of each wing section extends at an acute angle B relative to a line extending along and outwardly from another edge 60 of the central section. Preferably, each wing section is formed with an elongate flange 62 along the longitudinal edge 58. It will be particularly noted that the longitudinal edge 58 is the edge of the wing section located furthest from the blades 14 of the fan device (see FIG. 1). It will be appreciated that these flanges, which preferably extend substantially the length of their respective wing sections, help to stiffen and strengthen the support bracket and thus help to prevent vibration when the fan is operating. In one embodiment, the flanges are each 1.5 inches wide. Moreover, because the elongate flange 62 is located away from the path of rotation of the fan blades, any possible disruption of the air flow through the opening 32 is minimized. Because there is only the thin edge 54 of each wing section located near the path of rotation of the fan blades, it will be seen that in this region, the support bracket only interferes with the air flow to the extent of the thickness of the sheet metal from which the bracket is formed, an interference which is minimal. Preferably, each elongate flange 62 is substantially perpendicular to a planar main portion 65 of its respective wing section. The elongate flange 62 can be omitted on small fan sizes or where the metal thickness alone will provide sufficient rigidity.

Each wing section is formed with a relatively short connecting flange 70 at its outer end and each of these connecting flanges is attached by threaded fasteners, such as bolts and cooperating threaded nuts, to the support member 34. Connecting bolts 72 are illustrated in FIG. 2. The preferred illustrated flange 70 has two bolt holes formed therein. However, the connecting flange could be formed with only one bolt hole or with more than two. It will be understood that by using bolts and nuts to connect each support bracket, the support brackets can be attached easily and with ordinary tools to the support member and it is also easy to detach the support bracket and, if necessary, replace it with another support bracket of similar construction.

The preferred illustrated support bracket also has an outer end portion 75 at the outer end of each wing section, this outer end portion projecting in a direction parallel to a central axis of rotation of the motor shaft 18 towards the fan blades 14. This direction is indicated by the arrow X in FIG. 5. The projection is provided at the outer end in order to form a suitable recess 77 for the passage of the fan blades (see FIG. 1). The depth and size of the recess will, of course, depend on the location of these blades relative to the support brackets and the size of the blades.

In the preferred construction of the fan apparatus of the invention, the two support brackets 36, 38 are identical both in size and construction and thus it is not necessary to make two or more different types of support brackets for a particular application.

It will also be appreciated that the size and dimensions of a particular support bracket constructed in accordance with this invention will depend upon the size of the fan and the motor to be mounted and the particular installation requirements. In one particular support bracket constructed and formed for a 36 inch diameter fan, the length L of the central section 40 is 10.33 inches while the distance D measured between the centers of the outer bolt holes on the two connecting flanges 70 is about 33 inches. Also, in this embodiment, the rectangular central section 40 has a depth or width W of at least 7 inches which is the distance measured in the direction of the central axis of rotation of the shaft. The width of the central section as shown in FIG. 5 can be less than the length L.

It will also be understood that the preferred fan apparatus of the invention utilizes an electric motor with two mounting plates or two sets of mounting feet located on opposite sides of the electric motor. It will be appreciated that most electric motors used in conjunction with fans are provided with only one mounting plate or one set of mounting feet on one side. Although it is not normal for motor manufacturers to provide two sets of mounting plates or mounting feet on opposite sides of the motor, it is possible to order such motors for use in manufacturing the fan apparatus of the invention without incurring substantial additional cost.

Although the preferred form of support bracket of the invention is made by forming and shaping a piece of sheet metal of suitable thickness, it is also possible to construct the support bracket by means of casting, if desired.

Figure 6:
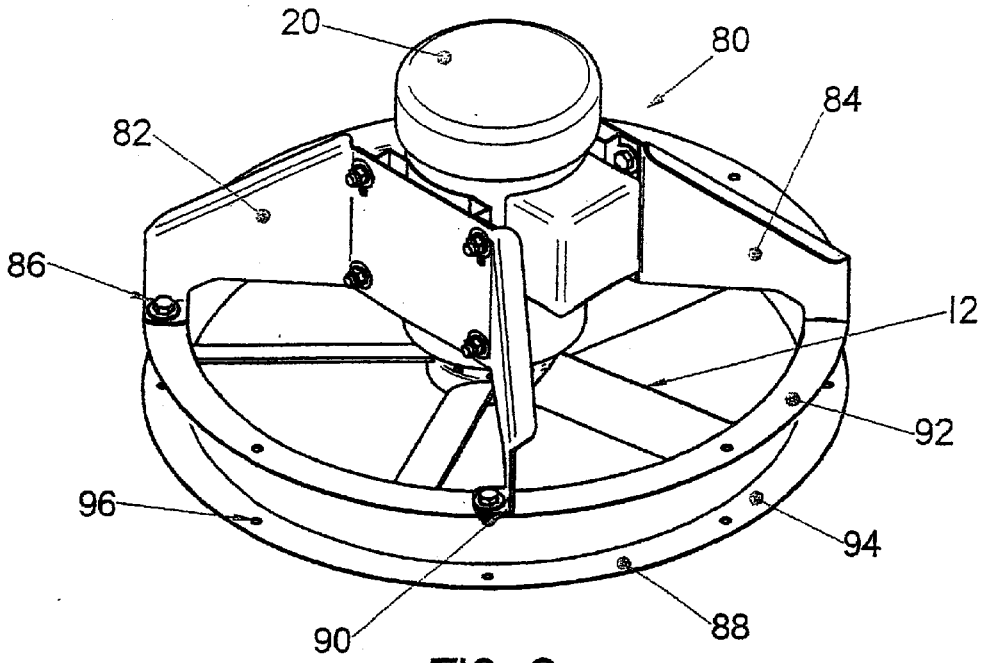
FIG. 6 is a perspective view of a second embodiment of a fan apparatus wherein the fan propeller rotates in a circular frame.

FIG. 6 illustrates a second embodiment of a fan apparatus 80 which is similar to the fan apparatus 10 of FIG. 1 except for the differences noted hereinafter. This fan apparatus includes a fan propeller 12 which is rotated by a standard, electrical fan motor 20 having two mounting plates. These mounting plates are connected to two support brackets 82 and 84 which are very similar in their construction to the above described support brackets 36, 38. The only difference in these mounting brackets is that only a single mounting bolt 86 is used to connect the outer end of each support bracket to a circular fan support structure 88. Each wing section of the support bracket 82, 84 is formed with a connecting tab or flange 90 at its outer end and this tab or flange is formed with a single bolt hole.

The illustrated circular fan support structure 88 is preferably a rolled channel frame formed with radially outwardly extending flanges 92, 94. It will be appreciated that the internal diameter of this rolled channel frame is substantially the same as the total effective diameter of the blades of the fan. Fastener holes 96 formed in the channel frame can be used to connect this channel frame to suitable supports which can be of known construction.

Figure 7:
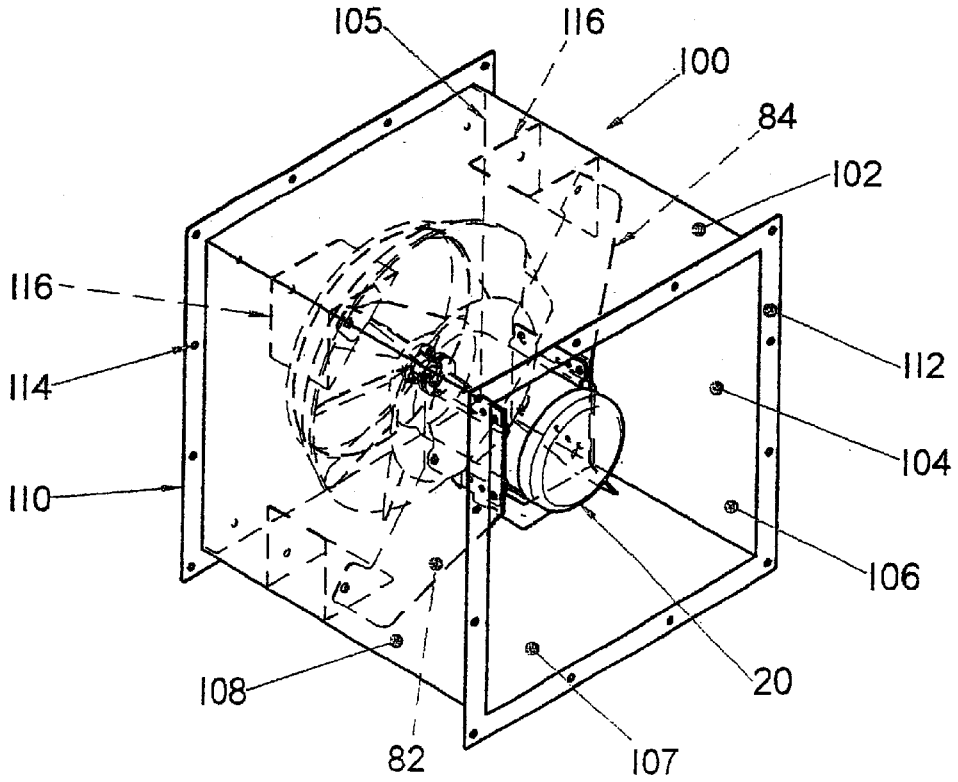
FIG. 7 is a perspective view of a third embodiment of a fan apparatus wherein the fan is mounted in a square box housing.

A third embodiment of fan apparatus is illustrated in FIG. 7, this apparatus being generally indicated by reference 100. In this embodiment, the propeller fan and its drive motor 20 are mounted in a square or rectangular box housing or enclosure 102 having an open outlet end at 104. The housing is formed with four rectangular sides indicated at 105 to 108. Suitable, peripheral connecting flanges 110 and 112 can be formed at opposite ends of the housing in order to permit the housing to be mounted to a rigid support structure (not shown). It will be understood that the inlet end 114 of the housing can be fitted with a square or rectangular inlet plate similar to the member 34 shown in FIG. 1, this inlet plate forming a circular opening for the fan.

Mounted within the housing 102 are four triangular comer brackets 116, at least three of which can be seen in FIG. 7, these being illustrated by dash lines. Connected to these corner brackets are two, similar support brackets 82, 84 which can be of the same construction as those illustrated in FIG. 6. Again, only one bolt, (not shown) is normally used to connect each end of each support bracket to the adjacent comer bracket. However, it is possible for two bolts to be used in a larger version of this fan apparatus. Preferably the four corner brackets are rigidly mounted by welding to the inner sides of the housing.

It will be appreciated that the support brackets and the fan apparatus of the invention provide a number of advantages to the manufacturer and to the users of these devices. The wing sections of each bracket, which extend radially when mounted on a motor as shown, provide superior stiffness and strength in both the radial and axial directions compared to previously used motor mounts. Because both the support brackets and their respective wing sections are identical, the inventory of these support brackets can be less than would be the case if two or more different support members are used. It will also be seen that the support brackets of the invention are designed to stack, thus minimizing space requirements for these brackets when they are being stored or transported.

It will be further noted that because the two wing sections are relatively broad or wide, these wing sections act as straightening vanes, thus reducing the amount of swirl entering or leaving the fan propeller and thus improving performance. In addition, the preferred support brackets of the invention provide good access to the motor's electrical terminal box (not shown).

It will be readily apparent to those skilled in this art that various changes or modifications can be made to both the fan apparatus and the support bracket of this invention without departing from the spirit and scope of the invention. According, all such modifications and changes as fall within the scope of the appended claims are intended to be included in this invention.

What is claimed is:

1. A fan apparatus comprising:

a fan device having fan blades;

a motor for rotating said fan device, said motor having a rotatable output shaft projecting from one end of said motor and on which said fan device is mounted;

a fan support structure capable of supporting both said fan device and said motor and forming an opening for passage of an airflow through said fan device, said support structure including a support member defining said opening and two substantially similar support brackets connected to motor mounting surfaces on opposite sides of said motor and extending between said motor and said support member such that the motor is extended away from the support member, each support bracket being formed from one integral metal piece and comprising a central section connected to its respective motor mounting surface by means of fasteners and two substantially similar wing sections extending from opposite ends of said central section, whereby each wing section forms an obtuse angle with said central section and is detachably connected to said support member at an outer end of the wing section.

2. A fan apparatus according to claim 1 wherein each support bracket is made from sheet metal and each wing section tapers in width from its inner end adjacent said central section to its outer end.

3. A fan apparatus according to claim 1 wherein each wing section is formed with an elongate flange along one longitudinal edge thereof, said longitudinal edge being the edge of the wing section located furthest from said blades of the fan device.

4. A fan apparatus according to claim 1 wherein each wing section is formed with a connecting flange at its outer end and each connecting flange is attached by bolts and cooperating threaded nuts to said support member.

5. A fan apparatus according to claim 3 wherein said fasteners connecting each central section to its respective motor mounting surface are bolts that extend through holes formed in the central section.

6. A fan apparatus according to claim 3 wherein each elongate flange extends substantially the length of its respective wing section and is substantially perpendicular to a planar main portion of the respective wing section.

7. A fan apparatus according to claim 2 wherein said two support brackets are identical in both size and construction.

8. A fan apparatus according to claim 2 wherein said central section is rectangular and has a depth of at least 7 inches measured in the direction of a central axis of rotation of said shaft.

9. A fan apparatus according to claim 1 wherein each wing section is formed with an outer end portion that projects in a direction parallel to a central axis of rotation of said shaft and towards said fan blades.

10. A fan apparatus according to claim 2 wherein said central section is planar and said motor mounting surfaces are formed by flat metal mounting plates attached to the motor.

11. A support bracket for connecting a fan motor and attached fan to a main fan and motor supporting member having a hole for air flow, said bracket formed from an integral piece and comprising a substantially planar central section adapted for connection to a side of said fan motor and two substantially similar wing sections extending from opposite sides of said central section, wherein each wing section extends at an obtuse angle of about 135 degrees to said central section and is adapted for detachable connection to said main fan and motor supporting member having the hole for air flow at an outer end of the wing section.

12. A support bracket according to claim 11 wherein said bracket is made from sheet metal and each wing section tapers in width from an inner end adjacent said central section to said outer end thereof.

13. A support bracket according to claim 11 wherein each wing section is formed with an elongate stiffening flange along one longitudinal edge thereof.

14. A support bracket according to claim 12 wherein said central section is rectangular and has bolt holes formed therein to permit connection of said bracket to said fan motor by means of bolts.

15. A support bracket according to claim 11 wherein the outer end of each wing section is formed with a connecting flange having at least one bolt hole provided therein for attaching said bracket to said main fan and motor supporting member.

16. A support bracket according to claim 13 wherein said stiffening flange extends substantially the length of its respective wing section and extends substantially perpendicularly to a planar main portion of the respective wing section.

17. A support bracket according to claim 14 wherein said central section and adjacent inner ends of both wing sections each have a depth of at least 7 inches measured in the direction of a central axis of rotation of an output shaft of said fan motor when said bracket is in use and said fan motor is mounted thereon.

18. A support bracket according to of claim 11 wherein each wing section is formed with a planar outer end portion that projects parallel to a central axis of rotation of an output shaft of said fan motor and towards the fan when said fan motor and fan are mounted thereon.

19. A support bracket according to of claim 12 wherein each wing section is formed with a planar outer end portion that projects parallel to a central axis of rotation of an output shaft of said fan motor and towards the fan when said fan motor and fan are mounted thereon.

20. A support bracket according to of claim 13 wherein each wing section is formed with a planar outer end portion that projects parallel to a central axis of rotation of an output shaft of said fan motor and towards the fan when said fan motor and fan are mounted thereon.

* * * * *